US006102027A

United States Patent [19]

Tilby

[11] Patent Number: 6,102,027

[45] Date of Patent: Aug. 15, 2000

[54] COLLAPSIBLE AND PORTABLE OUTDOOR COOKING STOVE ASSEMBLY

[76] Inventor: Nolan C. Tilby, 1235 W. 3500 South, Ogden, Utah 84401

[21] Appl. No.: 09/426,507

[22] Filed: Oct. 26, 1999

[51] Int. Cl.[7] ..... F24C 5/20

[52] U.S. Cl. ..... 126/38; 126/40; 126/50; 248/188.6

[58] Field of Search ..... 126/38, 40, 50, 126/41 R, 9 B, 9 R, 25 A, 304 R, 305; 248/188.6, 167, 188.7, 528; 431/344, 345

[56] References Cited

U.S. PATENT DOCUMENTS

| | | | |
|---|---|---|---|
| 2,331,931 | 10/1943 | Robinson | 126/38 |
| 4,092,974 | 6/1978 | Zenzaburo | 126/38 |
| 4,454,859 | 6/1984 | Vincent | 126/40 |
| 4,508,095 | 4/1985 | Bloechel | 126/9 R |
| 4,548,192 | 10/1985 | Hsu | 126/25 R |
| 4,696,282 | 9/1987 | Incitti | 126/9 R |
| 4,726,350 | 2/1988 | Steinhauser | 126/38 |
| 5,117,808 | 6/1992 | Peters et al. | 126/38 |

*Primary Examiner*—James C. Yeung
*Attorney, Agent, or Firm*—Flanagan & Flanagan; John R. Flanagan; John K. Flanagan

[57] ABSTRACT

An outdoor cooking stove assembly includes a burner tube, a plurality of support legs and a fuel supply pipe. The burner tube is adapted to receive fuel from the fuel supply pipe through an open lower end portion of the burner tube. The fuel is ignitable within a combustion chamber of the burner tube such that a sustained flame projects upwardly through the burner tube and out from an upper end portion thereof. One support leg is fixedly mounted to the burner tube while the other support legs are pivotally mounted thereto. Each pivotally mounted support leg is pivotally movable relative to the burner tube and fixedly mounted support leg between first and second angularly-spaced positions. Each pivotally mounted support leg in the first position is disposed adjacent and in a generally parallel relationship to the fixedly mounted support leg such that the assembly is in a collapsed condition for storage and transport of the assembly. Each pivotally mounted support leg in the second position is spaced remote and disposed about 120 degrees apart from one another and from the fixedly mounted support leg such that the assembly is in an erected condition for use of the assembly and such that cookware may be placed on top of the support legs and thereby be spaced above but disposed adjacent to the upper end portion of the burner tube in communication with the flame of the burner tube.

22 Claims, 4 Drawing Sheets

COLLAPSIBLE AND PORTABLE OUTDOOR COOKING STOVE ASSEMBLY

BACKGROUND OF THE INVENTION

1. Field of the Invention

The present invention generally relates to outdoor cooking stoves and, more particularly, is concerned with an outdoor cooking stove assembly which is collapsible and portable.

2. Description of the Prior Art

People who spend time in the outdoors away from any kitchen or restaurant facilities generally need to eat like those who never go far from civilization. Many of these people, like most of us, prefer to eat cooked foods rather than uncooked or dried foods, even when miles away from the nearest road and when miles more away from the closest market or eatery. Portable cooking stoves are generally needed in order to prepare cooked foods in the outdoors. This is due to many backcountry camp sites in the United States not allowing fires, wood being hard to find and collect to have fires in many places where fires are allowed, and stoves being easier to use for cooking than fires, among other reasons.

Various portable cooking stoves have been developed over the years. Many of these stoves, however, are large and heavy and difficult to transport due to their size and weight. More compact portable cooking stoves have also been developed. Representative examples of such compact portable cooking stoves are disclosed in U.S. Pat. No. 4,508,095 to Bloechel, U.S. Pat. No. 4,548,192 to Hsu and U.S. Pat. No. 4,696,282 to Incitti. While these and other prior art compact portable cooking stoves may operate satisfactorily under the specific conditions for which they were designed, none of them seem to provide an optimum combination of cooking power, compactness and efficiency for cooking in the outdoors.

Consequently, a need exists for innovations in compact portable cooking stoves which will provide a more effective solution for cooking in the outdoors than is found in the prior art and without introducing any new problems in the process.

SUMMARY OF THE INVENTION

The present invention provides an outdoor cooking stove assembly designed to satisfy the aforementioned need. The outdoor cooking stove assembly of the present invention is both collapsible and portable. The outdoor cooking stove assembly is constructed so as to utilize a minimum number of parts and a minimum number of different parts. Also, it is relatively small in size in comparison to prior art compact portable cooking stoves and is generally lightweight and easy to handle. Further, it has a relatively high level of cooking power and is compact and efficient for cooking outdoors and may be used for various purposes, including cooking, boiling, fire starting, heating and the like.

Accordingly, the present invention is directed to an outdoor cooking stove assembly which comprises: (a) a burner tube having opposite upper and lower ends and defining a combustion chamber open at each of the upper and lower ends of the burner tube, the burner tube for receiving fuel through the open lower end thereof where the fuel is ignitable within the combustion chamber such that a sustained flame projects upward through the burner tube and out from the upper end thereof; (b) means for supplying fuel to the lower end of the burner tube; and (c) a plurality of support legs mounted to the burner tube, at least one of the support legs being pivotally movable relative to the burner tube between a first position and a second position, the pivotally movable support leg in the first position being disposed adjacent to another of the support legs such that the assembly is in a collapsed condition for storage and transport of the assembly, the pivotally movable support leg in the second position being spaced remote from and disposed at an angle in relation to the other support leg such that the assembly is in an erected condition for use of the assembly and such that cookware may be placed on top of the support legs and thereby be spaced above but disposed adjacent to the upper end of the burner tube in communication with the flame of the burner tube.

More particularly, the burner tube has a pair of spaced apart mounting flanges, one being disposed at the upper end of the burner tube and the other being disposed at the lower end of the burner tube. Each mounting flange defines a plurality of spaced apart holes with each hole of one mounting flange being paired and aligned with one hole of the other mounting flange such that each pair of aligned holes of the mounting flanges receives one of the support legs therethrough.

The assembly also comprises at least one support leg brace and at least one windscreen plate. The support leg brace has opposite ends and is releasably interconnected at the opposite ends thereof to and extends between adjacent ones of the support legs when the at least one pivotally movable support leg of the plurality thereof is in the second position such that the cookware may be placed on top of the support leg brace and the support legs. The windscreen plate is releasably mounted to and disposed below the support leg brace for minimizing the effects of wind on the flame of the burner tube.

The assembly further comprises a flame spreading annular disk and a flame modifying annular disk. The flame spreading annular disk is removably mounted to the support legs and spaced above but disposed adjacent to the upper end of the burner tube in communication with the flame of the burner tube for dispersing the flame of the burner tube into a generally flower-like configuration. The flame modifying annular disk is removably inserted and retained within the combustion chamber of the burner tube for causing a flame ignition point of the flame of the burner tube to change from near the lower end of the burner tube to near the upper end of the burner tube such that the flame of the burner tube burns at a lower temperature than when the flame modifying annular disk is not present.

The present invention also is directed to an outdoor cooking stove assembly which comprises: (a) a burner tube having opposite upper and lower end portions and defining a combustion chamber open at each of the upper and lower end portions of the burner tube, the burner tube for receiving fuel through the lower end portion thereof where the fuel is ignitable within the combustion chamber such that a sustained flame projects upward through the burner tube and out from the upper end portion thereof; (b) means for supplying fuel to the lower end portion of the burner tube, the fuel supplying means including a fuel supply pipe having an end portion disposed below the lower end portion of the burner tube and an orifice defined in the end portion so as to aim upwardly through combustion chamber of the burner tube; and (c) means for supporting the burner tube so as to be capable of converting the assembly between a collapsed condition for storage and transport of the assembly and an erected condition for use of the assembly in supporting cookware spaced above but disposed adjacent to the upper end portion of the burner tube in communication with the flame of the burner tube. The burner tube has an inside diameter A and the orifice of the fuel supply pipe is located along the diameter A of the burner tube at a distance B equal to about 0.3 of the diameter A of the burner tube such that fuel jetting from the orifice upwardly into the burner tube causes a venturi effect drawing air into the open lower end portion of the burner tube which mixes with the fuel. The orifice of the fuel supply pipe has a diameter C equal to about 0.05 times the diameter A of the burner tube. Also, the burner tube has a side aperture in the lower end portion through which a flame can be extended for igniting the fuel mixed with air.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
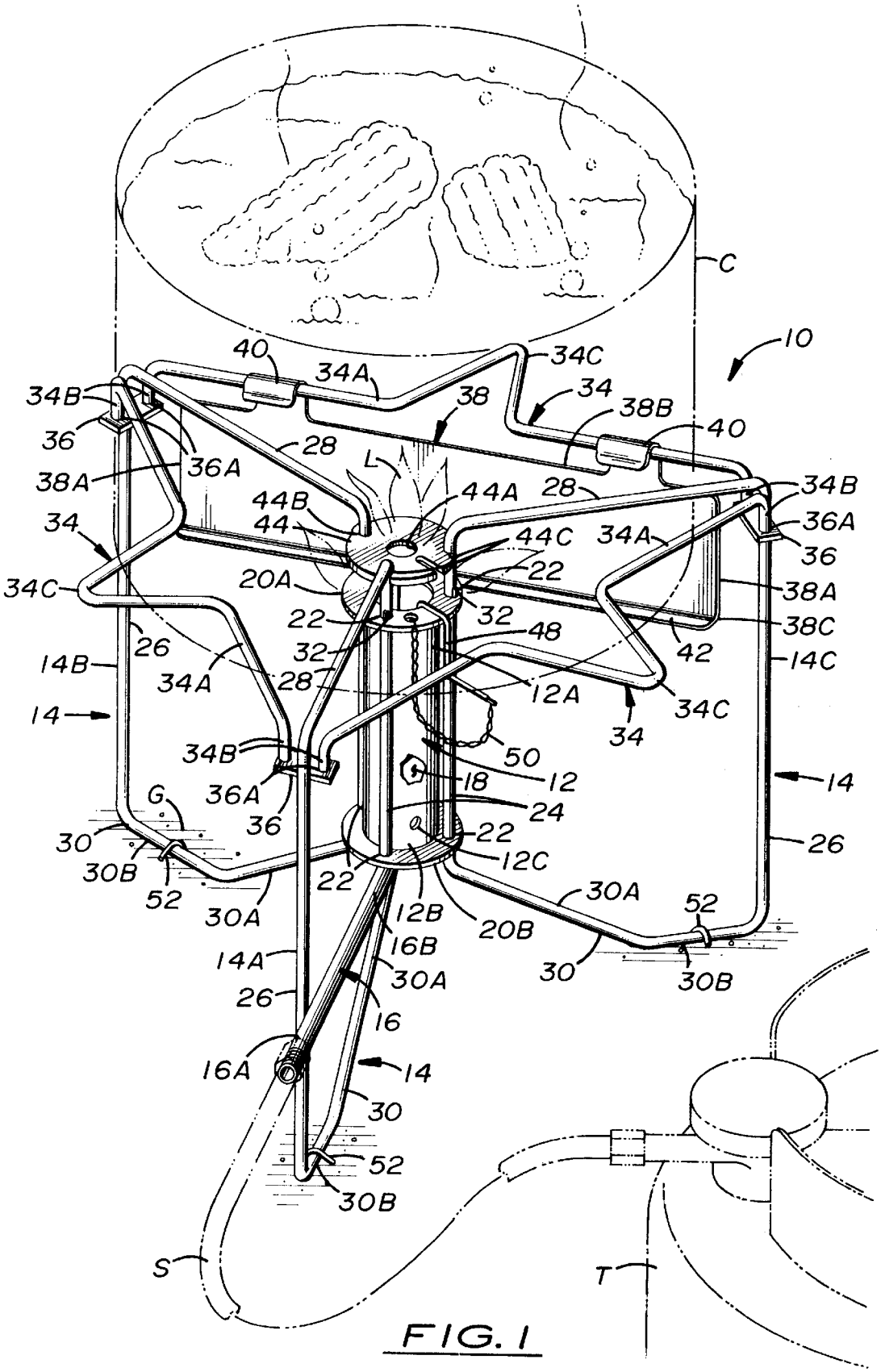
FIG. 1 is a perspective view of an outdoor cooking stove assembly of the present invention showing a burner tube and plurality of support legs of the assembly in an erected condition.
Figure 4:
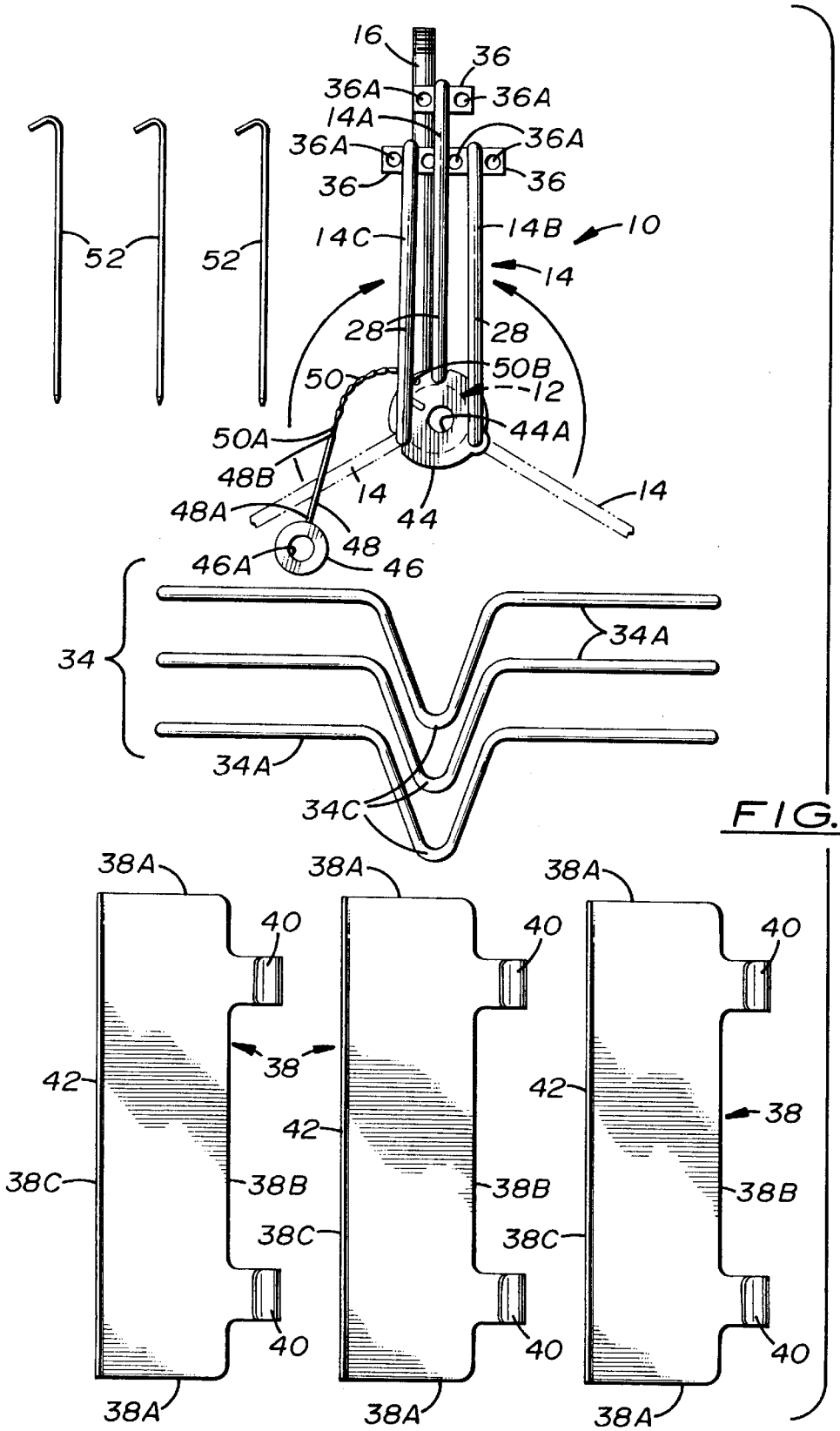
FIG. 4 is a layout view of the parts of the assembly with some parts shown in disassembled form and the burner tube and support legs shown in a collapsed condition.

Referring to the drawings and particularly to FIG. 1, there is illustrated an outdoor cooking stove assembly, generally designated 10, of the present invention. The outdoor cooking stove assembly 10 is convertible between an erected condition, as shown in FIG. 1, and a collapsed condition, as shown in FIG. 4. The outdoor cooking stove assembly 10 basically includes a burner tube 12, a plurality of support legs 14 and a fuel supply pipe 16. The parts of the assembly 10 are made of a substantially rigid heat resistant material, such as stainless steel.

Figure 3:
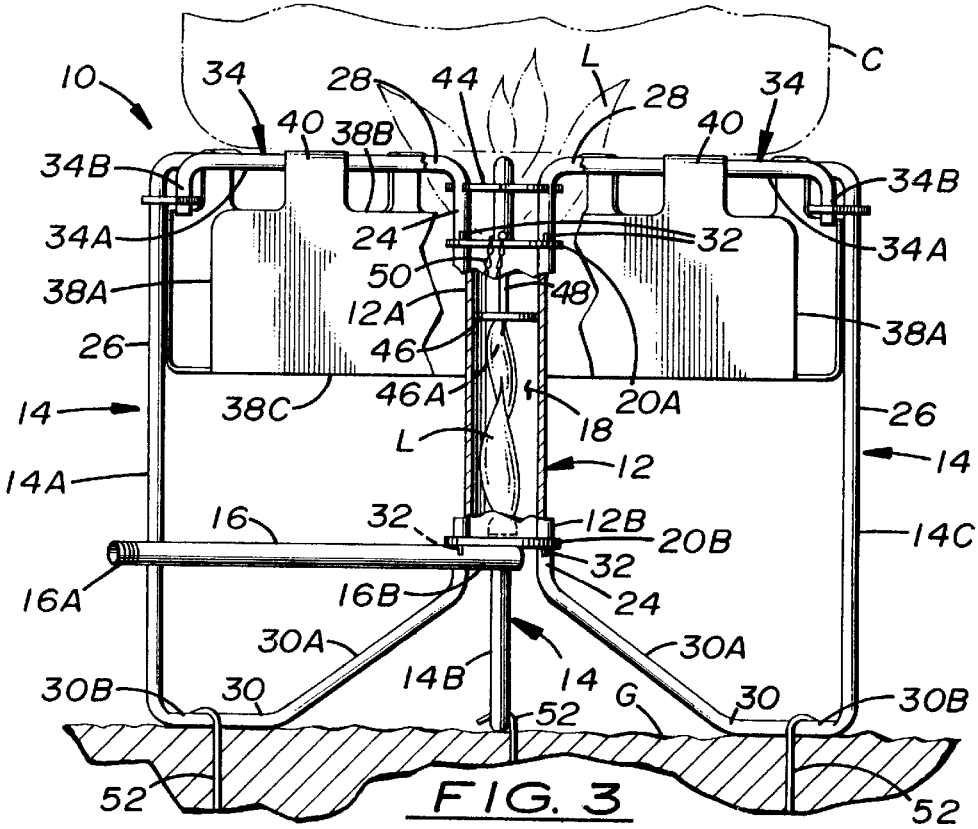
FIG. 3 is a side elevational view of the assembly as seen along line 3—3 of FIG. 2 with some portions broken away and other portions in longitudinally sectioned form.

Referring now to FIGS. 1 and 3, the burner tube 12 of the assembly 10 has a generally cylindrical configuration and opposite upper and lower ends 12A, 12B. The burner tube 12 defines an interior combustion chamber 18 also having a generally cylindrical configuration and open at each of the upper and lower ends 12A, 12B of the burner tube 12. The burner tube 12 is adapted for receiving a suitable fuel, such as LPG/propane, natural gas, vaporized liquid fuels or any suitable vaporized gas or the like, from an external source, such as a tank T of the fuel. One of the support legs 14A preferably is fixedly mounted to the burner tube 12 so as to retain the burner tube 12 in its particular orientation while the assembly 10 is in use. The other of the support legs 14B, 14C preferably are pivotally mounted to the burner tube 12. The fuel supply pipe 16 of the assembly 10 delivers the fuel from the tank T to the burner tube 12. The fuel supply pipe 16 has opposite open outer and inner ends 16A, 16B. The outer end 16A of the fuel supply pipe 16 is coupled in fuel flow communication with one end of a tubing S. The other end of the tubing S is connected to the fuel tank T. The fuel supply pipe 16 is attached to the fixedly mounted support leg 14A so as to locate the other end 16B of the fuel supply pipe 16 under the lower end portion 12B and in communication with the combustion chamber 18 of the burner tube 12. The fuel is sprayed from an orifice 16C (see FIGS. 5 and 6) defined in the other end 16B of the fuel supply pipe 16 through the open lower end portion 12B and into the combustion chamber 18 of the burner tube 12. The fuel spray causes a venturi effect which draws air into the lower end portion 12B of the burner tube 12 and upwardly through the combustion chamber 18. The fuel and air mix in the combustion chamber 18 and are ignitable within the combustion chamber 18. The burner tube 12 has an aperture 12C defined in a side portion thereof which is spaced above but disposed adjacent to the lower end portion 12B of the burner tube 12. The aperture 12C is provided for receiving a lighting flame of a match or a lighter (not shown) therethrough and into the combustion chamber 18. The venturi effect of the fuel draws the lighting flame into the combustion chamber 18. After ignition, the resulting burning mixture increases in velocity and is exhausted from the upper end portion 12A of the burner tube 12 for heating purposes and such that a sustained flame L projects out from the upper end portion 12A of the burner tube 12.

The burner tube 12 also has a pair of spaced apart upper and lower mounting flanges 20A, 20B which are substantially identical to one another and disposed respectively at the upper and lower end portions 12A, 12B of the burner tube 12. Each mounting flange 20A, 20B has a substantially circular annular configuration. Each mounting flange 20A, 20B has a plurality of spaced apart holes 22 defined therethrough. The holes 22 also are substantially identical to one another with each hole 22 having a substantially circular configuration. The holes 22, preferably, number three. Each hole 22 of each mounting flange 20A, 20B is paired and aligned with one of the holes 22 of the other mounting flange 20A, 20B.

Referring now to FIGS. 1 to 4, the plurality of support legs 14, preferably, number three and are substantially identical to one another. Each support leg 14 has a polygonal multi-sided configuration and is in the form of a complete loop for added strength. Each support leg 14 has opposite inner and outer side sections 24, 26 and opposite upper and lower sections 28, 30. The inner and outer side sections 24, 26 are disposed in substantially parallel relation to one another with the inner side section 24 being disposed adjacent to the burner tube 12 and the outer side section 26 being spaced remote from the burner tube 12. The outer side section 26 has a length which is greater than a length of the inner side section 24. The upper section 28 extends between upper ends of the inner and outer side sections 24, 26 and is disposed in substantially perpendicular relation thereto. The lower section 30 extends between lower ends of the inner and outer side sections 24, 26. The lower section 30 also has a first portion 30A and a second portion 30B. The first portion 30A is disposed at an angle relative to the upper section 28 and to the second portion 30B. The second portion 30B is disposed in substantially parallel relation to the upper section 28 and in substantially perpendicular relation to the outer side sections 26. The first portion 30A has a length which is greater than a length of the second portion 30B. The upper section 28 has a length which is greater than the length of the first portion 30A of the lower section 30 and which is approximately the same as the length of the inner side section 24. The first portion 30A of the lower section 30 is disposed above the ground G while the second portion 30B rests on the ground G. The second portion 30B is reduced in length so as to minimize potential instability of the assembly 10 if placed on uneven or rough terrain and is positioned toward the outermost edge of the support leg 14 loop to provide a broader stance for stability. The outer side section 26 is also straight to provide stability when the assembly 10 is placed on its side.

Each support leg 14 is made from small diameter round stock and has a generally circular cross-sectional shape. Each hole 22 of the upper and lower mounting flanges 20A, 20B of the burner tube 12 has a diameter which is slightly greater than a diameter of one of the support legs 14 such that each pair of aligned holes 22 of the mounting flanges 20A, 20B receives one of the support legs 14 therethrough. The one fixedly mounted support leg 14A is fixed to the mounting flanges 20A, 20B of the burner tube 12 at the location of the respective pair of aligned holes 22 therein. The other two pivotally mounted support legs 14B, 14C are pivotally coupled to the mounting flanges 20A, 20B of the burner tube 12 and, more particularly, are pivotally received through the pairs of aligned holes 22 of the mounting flanges 20A, 20B of the burner tube 12. The inner side section 24 of each support leg 14A, 14B, 14C has dimples 32 or the like formed thereon which are disposed adjacent to the upper and lower ends of the inner side section 24 respectively above and below the upper and lower mounting flanges 20A, 20B of the burner tube 12. These dimples 32 cannot passed through the holes 22 of the mounting flanges 20A, 20B such that the support legs 14 are thus set and retained at their elevation relative to the burner tube 12. The dimples 32 do not inhibit horizontal pivoting of the pivotally mounted support legs 14B, 14C relative to the burner tube 12.

Figure 2:
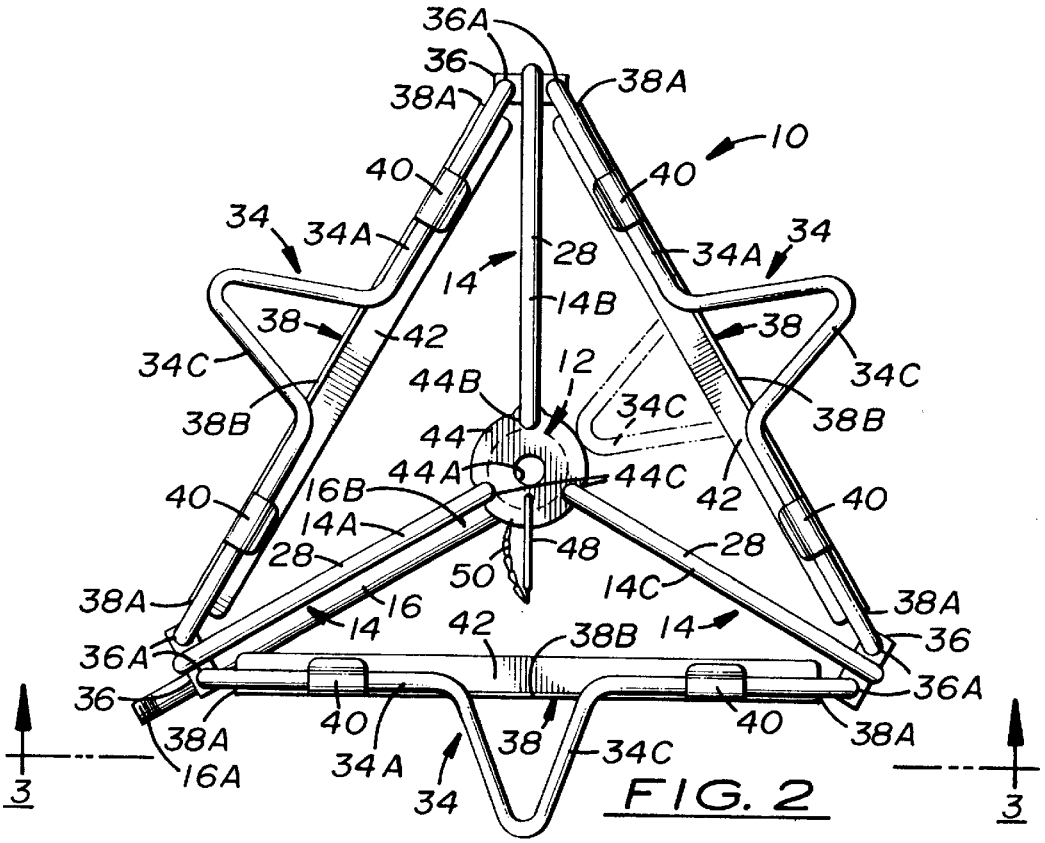
FIG. 2 is a top plan view of the assembly of FIG. 1.

Each of the pivotally mounted support legs 14B, 14C is pivotally movable between a first position and a second position. Each of the pivotal support legs 14B in the first position is disposed adjacent and in substantially parallel relationship to the fixed support leg 14A and to the other of the pivotal support legs 14B, 14C such that the assembly 10 is in the collapsed condition for storage and transport of the assembly 10, as shown in FIG. 4. Each of the pivotal support legs 14B, 14C in the second position are spaced remote from and disposed at an angle in relation to the fixed support leg 14A and to the other of the pivotal support legs 14B, 14C such that the assembly 10 is in the erected condition for use of the assembly 10, as shown in FIGS. 1 to 3. When the assembly 10 is in the erected condition, any suitable cookware C, as shown in phantom in FIGS. 1 and 3, may be placed on top of the support legs 14 and thereby be spaced above but disposed adjacent to the upper end portion 12A of the burner tube 12 in communication with the flame L of the burner tube 12 for use of the assembly 10. The support legs 14 are oriented such that the cookware C support area is a measured distance above the upper end portion 12A of the burner tube 12 to allow space for the flame L being exhausted to exit the burner tube 12 before striking the cookware C. Each of the pivotally mounted support legs 14B, 14C in the second position is, preferably, spaced from and disposed about 120 degrees apart from the other pivotally mounted support leg 14B, 14C and is spaced from and disposed about 120 degrees apart from the fixedly mounted support leg 14A. With each of the pivotally mounted support legs 14B, 14C in the second position, the three support legs 14 have a substantially Y-shaped configuration when viewed from above, as shown best in FIG. 2. By this design, the burner tube 12 and the support legs 14 all together represent the supporting structure of the assembly 10.

The assembly 10 also includes at least one and, preferably, a plurality of support leg braces 34. The support leg braces 34 are substantially identical to one another and their number preferably matches the number of the support legs 14. The support leg braces 34 number three if the support legs 14 number three. Each support leg brace 34 is made from small diameter round stock substantially similar to that comprising each support leg 14. Each support leg brace 34 has a substantially circular cross-sectional configuration and a diameter which is substantially the same as the diameter of each support leg 14. Each support leg brace 34 has a main portion 34A and a pair of opposite end portions 34B. The main portion 34A has a V-shaped bend 34C disposed at a center thereof and has straight segments on opposite sides of the V-shaped bend 34C. Each opposite end portion 34B is straight and is disposed in substantially perpendicular relation to the main portion 34A. The main portion 34A has a length which is substantially greater than a length of each of the opposite end portions 34B.

Each support leg brace 34 is releasably interconnected at the opposite end portions 34B to and extends between adjacent ones of the support legs 14 when the pivotally mounted support legs 14B, 14C are in their second positions such that the cookware C may be placed on top of the support leg braces 34 and the support legs 14. The support leg braces 34 are disposed at approximately the same height from the ground G as the upper sections 28 of the support legs 14. Also, each support leg brace 34 is preferably positioned with the V-shaped bend 34C of the main portion 34A pointed away from the burner tube 12, as shown in solid line form in FIGS. 1 and 2, but, alternatively, may be positioned with the V-shaped bend 34C of the main portion 34A pointed toward the burner tube 12, as shown in phantom in FIG. 2. When pointed away from the burner tube 12, the V-shaped bend 34C of the main portion 34 of each support leg brace 34 provides additional support for larger cookware C items. When pointed toward the burner tube 12, the V-shaped bend 34C of the main portion 34A of each support leg brace 34 provides additional support for smaller cookware C items.

Also, each support leg 14 has a brace mounting bracket 36. The brace mounting bracket 36 is mounted on the outer side section 26 and is spaced from but disposed adjacent to the upper end of the outer side section 26 of each respective support leg 14. Each brace mounting bracket 36 is on an inner side of the outer side section 26 facing toward the burner tube 12. The brace mounting bracket 36 has a substantially flat rectangular configuration and defines a pair of spaced apart holes 36A. The holes 36A of the brace mounting bracket 36 are substantially identical to one another and disposed on opposite lateral sides of the support leg 14. Each hole 36A has a substantially circular configuration and a diameter which is slightly greater than the diameter of the support leg brace 34 such that each hole 36A releasably receives one of the opposite end portions 34B of one of the support leg braces 34 therethrough. The holes 36A of the same brace mounting bracket 36 receive adjacent end portions 34B of different but adjacent support leg braces 34. The support leg braces 34 lock the pivotally mounted support legs 14B, 14C into their second positions. The support leg braces 34 all together have a substantially triangular configuration.

The assembly 10 also includes at least one and, preferably, a plurality of windscreen plates 38 which are substantially identical to one another. The number of the windscreen plates 38 matches the number of the support leg braces 34. The windscreen plates 38 number three if the support leg braces 34 number three. Each windscreen plate 38 has a substantially flat rectangular configuration and opposite lateral ends 38A and opposite upper and lower sides 38B, 38C. Each windscreen plate 38 has a length extending between the opposite ends 38A and a height extending between the upper and lower sides 38B, 38C. The length of each windscreen plate 38 is greater than its height. Each windscreen plate 38 also has a pair of spaced apart clips 40 which are formed on and extend upwardly from the upper side 38B of the windscreen plate 38. Each clip 40 is disposed closer to one of the lateral ends 38A than to the other of the lateral ends 38A of the windscreen plate 38. The clips 40 are substantially identical to one another, having a substantially hook-shaped configuration. Each windscreen plate 38 also has a ledge 42 formed on and extends outwardly from the lower side 38C of the windscreen plate 38. Each windscreen plate 38 is releasably mounted to and disposed below a respective on support leg brace 34 for minimizing the effects of wind on the flame L of the burner tube 12. The clips 40 of each windscreen plate 38 releasably receive the main portion 34A of a respective one support leg brace 34 on opposite sides of the V-shaped bend 34C of the main portion 34A of the support leg brace 34. Gaps between and on opposite sides of the clips 40 of each windscreen plate 38 permit the flame L to pass outside of the windscreen protected area to heat large cookware C.

The assembly 10 also includes a flame spreading annular disk 44. The flame spreading annular disk 44 has a substantially circular configuration and a diameter which is slightly greater than the diameter of the burner tube 12 and which is approximately the same as the diameter of each of the mounting flanges 20A, 20B of the burner tube 12. The flame spreading annular disk 44 is removably mounted to the support legs 14 and spaced above but disposed adjacent to the upper end portion 12A of the burner tube 12 in communication with the flame L of the burner tube 12 for dispersing the flame L of the burner tube 12 into a substantially flower-like configuration. More particularly, the flame spreading annular disk 44 defines a central hole 44A, an outer hole 44B and a pair of spaced apart notches 44C. Each of the central and outer holes 44A, 44B has a substantially circular configuration with the central hole 44A having a diameter which is greater than the diameter of the outer hole 44B. The flame L passes through the central hole 44A and disperses thereabove. The diameter of the outer hole 44B is slightly greater than the diameter of a support leg 14. One of the support legs 14 is disposed through the outer hole 44B. The flame spreading annular disk 44 is thus captured and rotatable on and slidable along the one support leg 14. Loss of the flame spreading annular disk 44 is prevented by the flame spreading annular disk 44 being captured on the one support leg 14, though the flame spreading annular disk 44 may be removed from the path of the flame L. Each of the notches 44C extends interiorly from an outer edge toward but is spaced from the central hole 44A of the flame spreading annular disk 44. Each notch 44C has a substantially semicircular configuration and a depth which is substantially the same as the diameter of the outer hole 44B. The flame spreading annular disk 44 may be placed adjacent to and removably mounted to the other two support legs 14 by insertion of the support legs 14 into the notches 44C. The dimples 32 on the support legs 14 retain the flame spreading annular disk 44 in place above the upper end portion 12A of the burner tube 12 high enough such that the flame L is allowed to exhaust and low enough such that the flame spreading annular disk 44 does not interfere with the cookware C. The flame spreading annular disk 44 serves to disperse the flame L pillar and shape it into a flame flower of significantly lower height to ensure safety when using the assembly 10 for cooking.

The assembly 10 still further includes a flame modifying annular disk 46. The flame modifying annular disk 46 has a substantially circular configuration and a diameter which is slightly less than the diameter of the burner tube 12. The flame modifying annular disk 46 is removably inserted and retained within the combustion chamber 16 of the burner tube 12 for causing a flame L ignition point of the flame L of the burner tube 12 to change from near the lower end portion 12B of the burner tube 12 to near the upper end portion 12A of the burner tube 12 such that the flame L of the burner tube 12 burns at a lower temperature than when the flame modifying annular disk 46 is not present. The flame modifying annular disk 46 has a central hole 46A. The flame modifying annular disk 46 blocks much of the air and fuel flow in the combustion chamber 18 of the burner tube 12 to achieve the change in the flame L ignition point and to cause the flame L to burn with a rich bright yellow or orange flame L similar to that of a traditional camp fire. The assembly 10 also includes a rod 48 and a chain 50. The rod 48 has opposite ends 48A, 48B and the chain 50 has opposite ends 50A, 50B. One end 48A of the rod 48 is mounted to an outer edge of the flame modifying annular disk 46. The other end 48B of the rod 48 is mounted to one end 50A of the chain 50. The other end 50B of the chain 50 is mounted to the upper mounting flange 20A of the burner tube 12 and such that the rod 48 and the flame modifying annular disk 46 are secured to the burner tube 12. The rod 48 has a substantially inverted U-shaped configuration adjacent to the end 48A which is mounted to the flame modifying annular disk 46. The rod 48 rises vertically above the flame modifying annular disk 46 and is bent at a right angle and extends away from the flame modifying annular disk 46 and is bent at another right angle and falls vertically downward to form its inverted U-shaped configuration and is also bent at another right angle and extends away from the flame modifying annular disk 46. The flame modifying annular disk 46 is lowered into the combustion chamber 18 from the upper end portion 12A of the burner tube 12 to a point which is spaced closer to the upper end portion 12A of the burner tube 12 than to the lower end portion 12B of the burner tube 12 and is positioned horizontally within the combustion chamber 18 of the burner tube 12. The top of the inverted "U" of the rod 48 rests on the upper mounting flange 20A of the burner tube 12 and retains the flame modifying annular disk 46 within the combustion chamber 18 of the burner tube 12.

The assembly 10 also includes a plurality of stakes 52. The stakes 52 are substantially identical to one another. The number of the stakes 52 matches the number of the support legs 14. The stakes 52 number three if the support legs 14 number three. Each stake 52 has a substantially J-shaped configuration and is inserted and driven into the ground G such that the stake 52 hooks over the second portion 30B of the lower section 30 of a support leg 14 and thereby retains the support leg 14 in place on the ground G.

Figure 6:
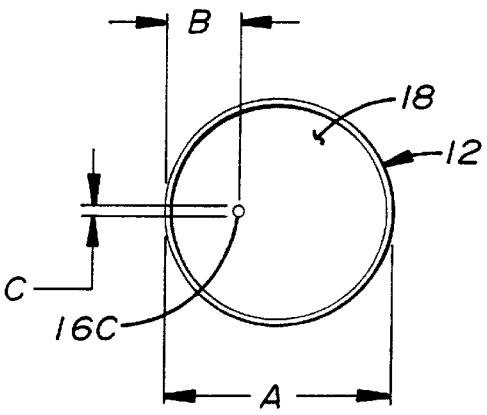
FIG. 6 is a diagrammatic top end view depicting the circular configurations and relative locations of a combustion chamber of the burner tube and an orifice of the fuel supply pipe of the assembly.
Figure 5:
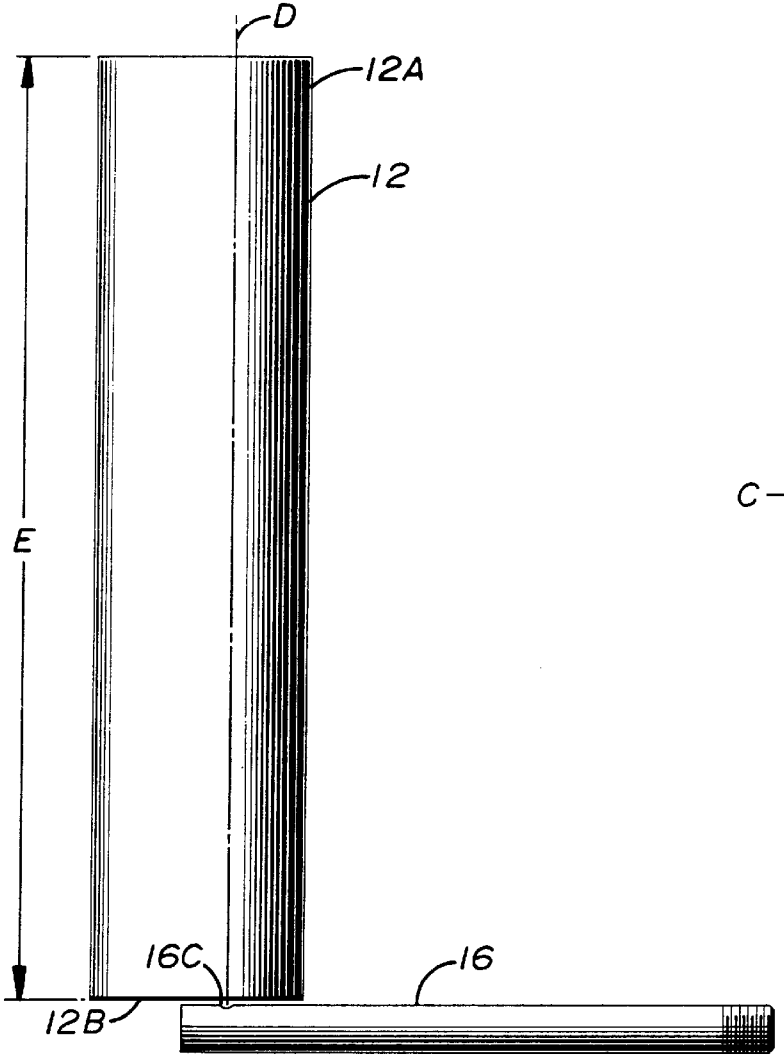
FIG. 5 is a diagrammatic elevational view depicting the burner tube and a fuel supply pipe of the assembly.

Referring to FIGS. 5 and 6, the burner tube 12 and fuel supply tube 16 having five interrelated dimensions which form the design criteria for the burner tube that are considered together and will contribute toward achieving operation of the outdoor cooking stove assembly 10 at a desired optimum level of performance. The length and diameter of the burner tube 12 and the diameter, placement and aiming of the orifice 16C of the fuel supply pipe 16 are all matched to cause the air and fuel to thoroughly mix and burn with a clean smooth flame L. The five dimensions and their relationship to one another are listed in summary form below.

A=burner tube inside diameter=1"/100,00 BTU/hour capacity.

B=orifice placement under burner tube=0.33×A (+/−1 degree).

C=orifice diameter=0.05×A (+/−5%).

D=orifice aim in burner tube=parallel to burner tube walls (+/−1 degree).

E=burner tube length=4.24×A (+/−10%).

A. The burner tube inside diameter A is selected based on the amount of fuel/air mixture necessary to produce the desired heat output. Decreasing the burner tube diameter reduces the air/fuel capacity and limits the maximum heat producing capacity of the burner tube. Increasing the burner tube diameter increases the air/fuel capacity and allows greater heat producing capacity.

When ignition occurs inside the burner tube, the tube walls confine the expanding gases causing a pressure increase. This pressure increase increases burn efficiency and produces greater velocity of the exhausting burning air/fuel mixture. The burner tube dimensions create a burn which, when burning at maximum capacity, ignites at a position of 10–20% of E from the bottom of the burner tube and produces a clean blue flame exiting the top to a height of 3 times E.

If the burner tube diameter is too small for the desired heat generation capacity, the stove will burn with excessive noise and flame outs will occur frequently due to excessive air/fuel velocity and the ignition point moving too far up the inside of the burner tube. If the burner tube diameter is too large for the desired heat generation capacity, the walls will not confine the burning gases to build pressure and the flame will not burn efficiently.

B. The fuel supply pipe orifice placement B should be 0.3A away from the inside burner tube wall for proper operation. The fuel jetting from the orifice of the fuel supply pipe so position into the burner tube causes the venturi effect drawing air into the burner tube which mixes with the fuel. Ignition occurs just above the orifice and the burning mixture begins to expand. With the offset orifice design, the burning gases expand outward away from the close wall toward the opposite wall of the burner tube until they fill the entire tube. This offset orifice and expansion of burning gases in a single direction create a smooth exhaust flame with little turbulence. Due to the close burner tube wall confining the expansion of the burn, lower heat output levels are possible without losing efficiency.

If the orifice is positioned in the center (0.5A) of the burner tube, the fuel jetting from the orifice interferes with the smooth burning flame causing a rolling or tumbling action (similar to a mushroom cloud) in the burner tube. This tumbling of the flame creates more noise and causes the flame to yellow or not burn efficiently, especially at lower heat output levels.

C. The fuel supply pipe orifice diameter C should be sized to deliver the proper amount of fuel (in combination with the fuel supply pressure) for the desired heat output while creating a venturi effect strong enough to draw in an appropriate amount of combustion air. This fuel/air mixture burns over 95% efficient producing a clean hot blue flame with very little carbon monoxide (CO).

If the fuel supply pipe orifice is larger than specified, the burner tube cannot get sufficient air and burns rich and yellow. If the fuel supply pipe orifice is smaller than specified, the fuel jet draws too little air and fails to mix and ignite until high in the burner tube. This causes an unstable burn which tumbles excessively and experiences flame outs. The high ignition point also causes cool flame temperatures because of lack of effective burner tube length before the burning gases exit the burner tube.

D. Aiming the fuel supply pipe orifice should be exact and parallel to the burner tube walls. Small errors of 1 to 4 degrees in aiming result in increased tumbling of the burning flame, greater noise levels from the burner, and yellow flame at lower levels. Errors of over 4 degrees cause swirling of the burning gases, less air intake from venturi effect, heavy yellowing of the flame, and lower flame temperatures.

E. The burner tube length E is used to confine the burning gases while their temperatures and velocity increase. If the length is too short, the gases fail to develop sufficient heat, exit the burner tube and rapidly turn cool and yellow. The velocity of the exiting flame is slower which reduces the flame coverage area on the underside of the cookware and makes the flame more susceptible to interference from wind. If the length of the burner tube is too long, the burning gases are mostly consumed while inside the tube, leaving too little flame coverage upon exit. This creates a smaller heat distribution pattern on the underside of the cookware defeating the even heating nature of the design.

To operate, select level ground G for placement of the assembly 10. Clear an area approximately three feet in diameter of all dry grass, sticks, leaves and other burnable material. Move the pivotal support legs 14B, 14C from their first positions to their second positions. Secure the support leg braces 34 to the support legs 14 and thereby lock the support legs 14 in place. If the cookware C is less than 12 inches in diameter, the support leg braces 34 should be secured with their V-shaped bends 34C pointed inwardly toward the burner tube 12. If the cookware C is 12 inches or greater in diameter, the support leg braces 34 should be secured with their V-shaped bends 34C pointed outwardly away from the burner tube 12. Lift the flame spreading annular disk 44 from the upper end portion 12A of the burner tube 12 and inspect the burner tube 12 for obstructions. Clear any debris or obstructions from inside of the burner tube 12 before continuing. Replace the flame spreading annular disk 46 over the upper end portion 12A of the burner tube 12. Stand the support legs 14 on the ground G in the center of the cleared area. Drive the stakes 52 into the ground G to anchor the support legs 14 on the ground G. The windscreen plates 38 may be attached to the support leg braces 34 to reduce the effects of breezes on the operation of the assembly 10. The gas hose or tubing S and the tank T should be inspected for damage. Fittings should be cleaned if necessary. Any damage should be repaired or parts should be replaced before using the assembly 10. Be sure the tank T valve is off and the regulator control knob is off. Attach the regulator to the tank T. Hand tighten the fitting here clockwise to a positive stop. Turn on the gas bottle valve and check the fittings for leaks with soapy water. Leaks will cause bubbling to appear in the soapy water. Any leaks should be repaired before lighting the fuel. Turn the regulator control knob clockwise to on one (1) turn. A slight hissing sound should be heard. Place a lighted match into the aperture 12C of the burner tube 12 to ignite the fuel. The flame L will be drawn into the combustion chamber 18 of the burner tube 12. Adjust the flame L to a desired level. In order to shut off flame L, turn the regulator control knob counter clockwise as far as it will go and then shut off the gas bottle valve. If problems occur, turn off the gas at the tank T valve. After turning off the assembly 10, do not touch it for a half hour to allow time for it to cool down.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube; and (c) a plurality of support legs mounted to said burner tube, at least one of said support legs being pivotally movable relative to said burner tube between a first position and a second position, said pivotally movable support leg in said first position being disposed adjacent to another of said support legs such that said assembly is in a collapsed condition for storage and transport of said assembly, said pivotally movable support leg in said second position being spaced remote from and disposed at an angle in relation to said other support leg such that said assembly is in an erected condition for use of said assembly and such that cookware may be placed on top of said support legs and thereby be spaced above but disposed adjacent to said upper end portion of said burner tube in communication with the flame of said burner tube;

(d) wherein said burner tube has a pair of spaced apart mounting flanges, one of said mounting flanges being disposed at said upper end portion of said burner tube and the other of said mounting flanges being disposed at said lower end portion of said burner tube, each of said mounting flanges defining a plurality of spaced apart holes, each of said holes of one of said mounting flanges being paired and aligned with one of said holes of the other of said mounting flanges such that each pair of aligned holes of said mounting flanges receives one of said support legs therethrough.

2. The assembly of claim 1 wherein said at least one pivotally movable support leg of said plurality thereof is pivotally received through said aligned holes of said mounting flanges of said burner tube.

3. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube;

(c) a plurality of support legs mounted to said burner tube, at least one of said support legs being pivotally movable relative to said burner tube between a first position and a second position, said pivotally movable support leg in said first position being disposed adjacent to another of said support legs such that said assembly is in a collapsed condition for storage and transport of said assembly, said pivotally movable support leg in said second position being spaced remote from and disposed at an angle in relation to said other support leg such that said assembly is in an erected condition for use of said assembly and such that cookware may be placed on top of said support legs and thereby be spaced above but disposed adjacent to said upper end portion of said burner tube in communication with the flame of said burner tube; and (d) at least one support leg brace having opposite ends and releasably interconnected at said opposite ends thereof to and extending between adjacent ones of said support legs when said at least one pivotally movable support leg of said plurality thereof is in said second position such that the cookware may be placed on top of said support leg brace and said support legs.

4. The assembly of claim 3 further comprising:

at least one windscreen plate releasably mounted to and disposed below said support leg brace for minimizing the effects of wind on the flame of said burner tube.

5. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube;

(c) a plurality of support legs mounted to said burner tube, at least one of said support legs being pivotally movable relative to said burner tube between a first position and a second position, said pivotally movable support leg in said first position being disposed adjacent to another of said support legs such that said assembly is in a collapsed condition for storage and transport of said assembly, said pivotally movable support leg in said second position being spaced remote from and disposed at an angle in relation to said other support leg such that said assembly is in an erected condition for use of said assembly and such that cookware may be placed on top of said support legs and thereby be spaced above but disposed adjacent to said upper end portion of said burner tube in communication with the flame of said burner tube; and (d) a flame spreading annular disk removably mounted to said support legs and spaced above but disposed adjacent to said upper end portion of said burner tube in communication with the flame of said burner tube for dispersing the flame of said burner tube into a substantially flower-like configuration.

6. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube;

(c) a plurality of support legs mounted to said burner tube, at least one of said support legs being pivotally movable relative to said burner tube between a first position and a second position, said pivotally movable support leg in said first position being disposed adjacent to another of said support legs such that said assembly is in a collapsed condition for storage and transport of said assembly, said pivotally movable support leg in said second position being spaced remote from and disposed at an angle in relation to said other support leg such that said assembly is in an erected condition for use of said assembly and such that cookware may be placed on top of said support legs and thereby be spaced above but disposed adjacent to said upper end portion of said burner tube in communication with the flame of said burner tube; and a flame modifying annular disk removably inserted and retained within said combustion chamber of said burner tube for causing a flame ignition point of the flame of said burner tube to change from near said lower end portion of said burner tube to near said upper end portion of said burner tube such that the flame of said burner tube burns at a lower temperature than when said flame modifying annular disk is not present.

7. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube; and (c) a plurality of support legs, one of said support legs being fixedly mounted to said burner tube, the other of said support legs being pivotally mounted to said burner tube, each of said pivotally mounted support legs being pivotally movable relative to said burner tube and said fixedly mounted support leg between a first position and a second position, each of said pivotally mounted support legs in said first position being disposed adjacent to said one fixedly mounted support leg such that said assembly is in a collapsed condition for storage and transport of said assembly, each of said pivotally mounted support legs in said second position being spaced remote from and disposed at an angle in relation to one another and to said one fixedly mounted support leg such that said assembly is in an erected condition for use of said assembly and such that cookware may be placed on top of said support legs and thereby be spaced above but disposed adjacent to said upper end portion of said burner tube in communication with the flame of said burner tube;

(d) wherein said burner tube has a pair of spaced apart mounting flanges, one of said mounting flanges being disposed at said upper end portion of said burner tube and the other of said mounting flanges being disposed at said lower end portion of said burner tube, each of said mounting flanges defining a plurality of spaced apart holes, each of said holes of each of said mounting flanges being paired and aligned with one of said holes of the other of said mounting flanges such that each pair of said aligned holes of said mounting flanges receives one of said support legs therethrough.

8. The assembly of claim 7 wherein said pivotally mounted support legs of said plurality thereof are pivotally received through pairs of said aligned holes of said mounting flanges of said burner tube.

9. The assembly of claim 7 wherein said plurality of support legs includes three support legs, one of said three support legs being fixedly mounted to said burner tube, the other two of said three support legs being pivotally mounted to said burner tube.

10. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube;

(c) a plurality of support legs, one of said support legs being fixed mounted to said burner tube, the other of said support legs being pivotally mounted to said burner tube, each of said pivotally mounted support legs being pivotally movable relative to said burner tube and said fixedly mounted support leg between a first position and a second position, each of said pivotally mounted support legs in said first position being disposed adjacent to said one fixedly mounted support leg such that said assembly is in a collapsed condition for storage and transport of said assembly, each of said pivotally mounted support legs in said second position being spaced remote from and disposed at an angle in relation to one another and to said one fixedly mounted support leg such that said assembly is in an erected condition for use of said assembly and such that cookware may be placed on top of said support legs and thereby be spaced above but disposed adjacent to said upper end portion of said burner tube in communication with the flame of said burner tube; and (d) a plurality of support leg braces each having opposite ends and releasably interconnected at said opposite ends thereof to and extending between adjacent ones of said support legs when each of said pivotally mounted support legs of said plurality is in said second position such that the cookware may be placed on top of said support leg braces and said support legs.

11. The assembly of claim 10 further comprising:

a plurality of windscreen plates each releasably mounted to and disposed below one of said support leg braces for minimizing the effects of wind on the flame of said burner tube.

12. The assembly of claim 10 further comprising:

a flame spreading annular disk removably mounted to said support legs and spaced above but disposed adjacent to said upper end portion of said burner tube in communication with the flame of said burner tube for dispersing the flame of said burner tube into a substantially flower-like configuration.

13. The assembly of claim 10 further comprising:

a flame modifying annular disk removably inserted and retained within said combustion chamber of said burner tube for causing a flame ignition point of the flame of said burner tube to change from near said lower end portion of said burner tube to near said upper end portion of said burner tube such that the flame of said burner tube burns at a lower temperature than when said flame modifying annular disk is not present.

14. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube, said fuel supplying means including a fuel supply pipe having an end portion disposed below said lower end portion of said burner tube and an orifice defined in said end portion so as to aim upwardly through combustion chamber of said burner tube; and (c) means for supporting said burner tube so as to be capable of converting said assembly between a collapsed condition for storage and transport of said assembly and an erected condition for use of said assembly in supporting cookware spaced above but disposed adjacent to said upper end portion of said burner tube in communication with the flame of said burner tube, said means for supporting said burner tube including a plurality of support legs, one of said support legs being fixedly mounted to said burner tube, the other of said support legs being pivotally mounted to said burner tube, each of said pivotally mounted support legs being pivotally movable relative to said burner tube and said fixedly mounted support leg between a first position and a second position, each of said pivotally mounted support legs in said first position being disposed adjacent to said one fixedly mounted support leg such that said assembly is in a collapsed condition for storage and transport of said assembly, each of said pivotally mounted support legs in said second position being spaced remote from and disposed at an angle in relation to one another and to said one fixedly mounted support leg such that said assembly is in an erected condition for use of said assembly and such that cookware may be placed on top of said support legs and thereby be spaced above but disposed adjacent to said upper end portion of said burner tube in communication with the flame of said burner tube;

(d) wherein said burner tube has a pair of spaced apart mounting flanges, one of said mounting flanges being disposed at said upper end portion of said burner tube and the other of said mounting flanges being disposed at said lower end portion of said burner tube, each of said mounting flanges defining a plurality of spaced apart holes, each of said holes of one of said mounting flanges being paired and aligned with one of said holes of the other of said mounting flanges such that each pair of said aligned holes of said mounting flanges receives one of said support legs therethrough.

15. The assembly of claim 14 wherein said burner tube has an inside diameter A and said orifice of said fuel supply pipe is located along said diameter A of said burner tube at a distance B equal to about 0.3 of said diameter A of said burner tube such that fuel jetting from said orifice upwardly into said burner tube causes a venturi effect drawing air into said open lower end portion of said burner tube which mixes with the fuel.

16. The assembly of claim 15 wherein said orifice has a diameter C equal to about 0.05 times said diameter A of said burner tube.

17. The assembly of claim 15 wherein said burner tube has a side aperture in said lower end portion through which a flame can be extended for igniting the fuel mixed with air.

18. The assembly of claim 14 wherein said pivotally mounted support legs of said plurality thereof are pivotally received through pairs of said aligned holes of said mounting flanges of said burner tube.

19. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube, said fuel supplying means including a fuel supply pipe having an end portion disposed below said lower end portion of said burner tube and an orifice defined in said end portion so as to aim upwardly through combustion chamber of said burner tube;

(c) means for supporting said burner tube so as to be capable of converting said assembly between a collapsed condition for storage and transport of said assembly and an erected condition for use of said assembly in supporting cookware spaced above but disposed adjacent to said upper end portion of said burner tube in communication with the flame of said burner tube, said means for supporting said burner tube including a plurality of support legs, one of said support legs being fixedly mounted to said burner tube, the other of said support legs being pivotally mounted to said burner tube, each of said pivotally mounted support legs being pivotally movable relative to said burner tube and said fixedly mounted support leg between a first position and a second position, each of said pivotally mounted support legs in said first position being disposed adjacent to said one fixedly mounted support leg such that said assembly is in a collapsed condition for storage and transport of said assembly, each of said pivotally mounted support legs in said second position being spaced remote from and disposed at an angle in relation to one another and to said one fixedly mounted support leg such that said assembly is in an erected condition for use of said assembly and such that cookware may be placed on top of said support legs and thereby be spaced above but disposed adjacent to said upper end portion of said burner tube in communication with the flame of said burner tube; and (d) a plurality of support leg braces each having opposite ends and releasably interconnected at said opposite ends thereof to and extending between adjacent ones of said support legs when each of said pivotally mounted support legs of said plurality thereof is in said second position such that the cookware may be placed on top of said support leg braces and said support legs.

20. The assembly of claim 19 further comprising:

a plurality of windscreen plates each releasably mounted to and disposed below one of said support leg braces for minimizing the effects of wind on the flame of said burner tube.

21. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube, said fuel supplying means including a fuel supply pipe having an end portion disposed below said lower end portion of said burner tube and an orifice defined in said end portion so as to aim upwardly through combustion chamber of said burner tube;

(c) means for supporting said burner tube so as to be capable of converting said assembly between a collapsed condition for storage and transport of said assembly and an erected condition for use of said assembly in supporting cookware spaced above but disposed adjacent to said upper end portion of said burner tube in communication with the flame of said burner tube, said means for supporting said burner tube including a plurality of support legs, one of said support legs being fixedly mounted to said burner tube, the other of said support legs being pivotally mounted to said burner tube, each of said pivotally mounted support legs being pivotally movable relative to said burner tube and said fixedly mounted support leg between a first position and a second position, each of said pivotally mounted support legs in said first position being disposed adjacent to said one fixedly mounted support leg such that said assembly is in a collapsed condition for storage and transport of said assembly, each of said pivotally mounted support legs in said second position being spaced remote from and disposed at an angle in relation to one another and to said one fixedly mounted support leg such that said assembly is in an erected condition for use of said assembly and such that cookware may be placed on top of said support legs and thereby be spaced above but disposed adjacent to said upper end portion of said burner tube in communication with the flame of said burner tube; and (d) a flame spreading annular disk removably mounted to said support legs and spaced above but disposed adjacent to said upper end portion of said burner tube in communication with the flame of said burner tube for dispersing the flame of said burner tube into a substantially flower-like configuration.

22. An outdoor cooking stove assembly, comprising:

(a) a burner tube having opposite upper and lower end portions and defining a combustion chamber open at each of said upper and lower end portions of said burner tube, said burner tube for receiving fuel through said lower end portion thereof where the fuel is ignitable within said combustion chamber such that a sustained flame projects upward through said burner tube and out from said upper end portion thereof;

(b) means for supplying fuel to said lower end portion of said burner tube, said fuel supplying means including a fuel supply pipe having an end portion disposed below said lower end portion of said burner tube and an orifice defined in said end portion so as to aim upwardly through combustion chamber of said burner tube;

(c) means for supporting said burner tube so as to be capable of converting said assembly between a collapsed condition for storage and transport of said assembly and an erected condition for use of said assembly in supporting cookware spaced above but disposed adjacent to said upper end portion of said burner tube in communication with the flame of said burner tube; and (d) a flame modifying annular disk removably inserted and retained within said combustion chamber of said burner tube for causing a flame ignition point of the flame of said burner tube to change from near said lower end portion of said burner tube to near said upper end portion of said burner tube and such that the flame of said burner tube burns at a lower temperature than when said flame modifying annular disk is not present.

* * * * *